US008911044B2

(12) United States Patent
Takamura

(10) Patent No.: US 8,911,044 B2
(45) Date of Patent: Dec. 16, 2014

(54) INKJET RECORDING APPARATUS AND RECORDING METHOD

(75) Inventor: Jun Takamura, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 46 days.

(21) Appl. No.: 13/337,447

(22) Filed: Dec. 27, 2011

(65) Prior Publication Data

US 2012/0169803 A1 Jul. 5, 2012

(30) Foreign Application Priority Data

Jan. 4, 2011 (JP) ..... 2011-000121

(51) Int. Cl.
*B41J 29/38* (2006.01)
*B41J 2/21* (2006.01)

(52) U.S. Cl.
CPC ..... *B41J 29/38* (2013.01); *B41J 2/2117* (2013.01)
USPC ..... 347/9; 347/5; 347/14; 347/19

(58) Field of Classification Search
CPC ..... B41J 29/38
USPC ..... 347/9
See application file for complete search history.

(56) References Cited

U.S. PATENT DOCUMENTS 6,193,347 B1 * 2/2001 Askeland et al. ..... 347/15
7,244,021 B2 * 7/2007 Arai ..... 347/102
8,328,313 B2 * 12/2012 Takeda et al. ..... 347/14
2005/0156965 A1 * 7/2005 Hoshino ..... 347/9
2006/0284906 A1 * 12/2006 Jeong et al. ..... 347/5
2008/0143768 A1 * 6/2008 Veenstra et al. ..... 347/12
2008/0278531 A1 * 11/2008 Ikeda et al. ..... 347/14
2010/0253724 A1 * 10/2010 Matsuzawa et al. ..... 347/12

FOREIGN PATENT DOCUMENTS

JP 2005-144749 6/2005
JP 2005-231350 9/2005
JP 2010-194847 9/2010

OTHER PUBLICATIONS

First Office Action of Reason for Rejection for Japanese Patent Application No. 2011-000121 Dated Dec. 3, 2013, 6 pgs.

* cited by examiner

*Primary Examiner* — Manish S Shah
*Assistant Examiner* — Jeremy Delozier
(74) *Attorney, Agent, or Firm* — Amin, Turocy & Watson, LLP

(57) ABSTRACT

According to one embodiment, an inkjet recording apparatus includes a plurality of inkjet heads of a multi-drop method, a first controller, and a second controller. The first controller controls ejection of ink drops from a first inkjet head for ejecting a first ink for which print resolution is required, in a manner that a number of ink dots formed in a main scanning direction is great, and that the number of ink drops ejected for each one of the ink dots is small. The second controller controls ejection of the ink drops from a second inkjet head for ejecting a second ink for which coverage over a recording surface of the recording medium is required, in a manner that a number of ink dots formed in the main scanning direction is small, and that the number of ink drops ejected for each of the ink dots is great.

15 Claims, 11 Drawing Sheets

INKJET RECORDING APPARATUS AND RECORDING METHOD

CROSS-REFERENCE TO RELATED APPLICATIONS

This application is based upon and claims the benefit of priority from Japanese Patent Application No. 2011-000121, filed on Jan. 4, 2011, the entire contents of which are incorporated herein by reference.

FIELD

Embodiments described herein relate generally to an inkjet recording apparatus comprising a multi-drop-type inkjet head, and a recording method thereof.

BACKGROUND

An ink jet recording apparatus which forms a color image on a white ground uses color inks, such as a black ink (K), a cyan ink (C), a magenta ink (M), and an yellow ink (Y), and a white ink. A white ground is formed on a print surface of a recording medium with the white ink, and thereafter, a color image is formed.

The color image formed by the ink jet recording apparatus improves more in quality as coverage of the print surface with the white ink increases. Therefore, the ink jet recording apparatus is devised to raise the coverage. For example, a number of print scans for the white ink is increased to be greater than the other color inks. Otherwise, a number of heads for the white ink is increased to be greater than the other color inks.

However, if the number of times for which scanning is performed to print the white ink is increased to be greater than the other color inks, image formation requires a long time. If the number of heads for the white ink is increased to be greater than for the other color inks, a total number of heads increases so that the whole apparatus becomes large. Further, product costs and maintenance costs increase also. Therefore, there are demands for an inkjet recording apparatus and a recording method which can solve problems described above.

DETAILED DESCRIPTION

In general, according to one embodiment, an inkjet recording apparatus includes: a plurality of inkjet heads of a multi-drop method, each of which controls a diameter of each ink dot formed on a recording medium by changing a number of ink drops to sequentially eject; a first controller; and a second controller. The first controller controls ejection of ink drops from a first inkjet head for ejecting a first ink for which print resolution is required, among the plurality of inkjet heads, in a manner that the number of ink dots formed in a main scanning direction as a printing direction during relative movement between the recording medium and the inkjet heads is great, and that the number of ink drops ejected for each one of the ink dots is small. The second controller controls ejection of ink drops from a second inkjet head for ejecting a second ink for which coverage over a recording surface of the recording medium is required, among the plurality of inkjet heads, in a manner that the number of ink dots formed in the main scanning direction is small, and that the number of ink drops ejected for each one of the ink dots is great.

Hereinafter, embodiments of an inkjet recording apparatus and a recording method will be described with reference to the drawings.

The embodiments relate to application to an inkjet recording apparatus 1 in which a white ground is formed on a print surface of a recording medium, and a color image is formed on the ground.

First Embodiment

Figure 1:
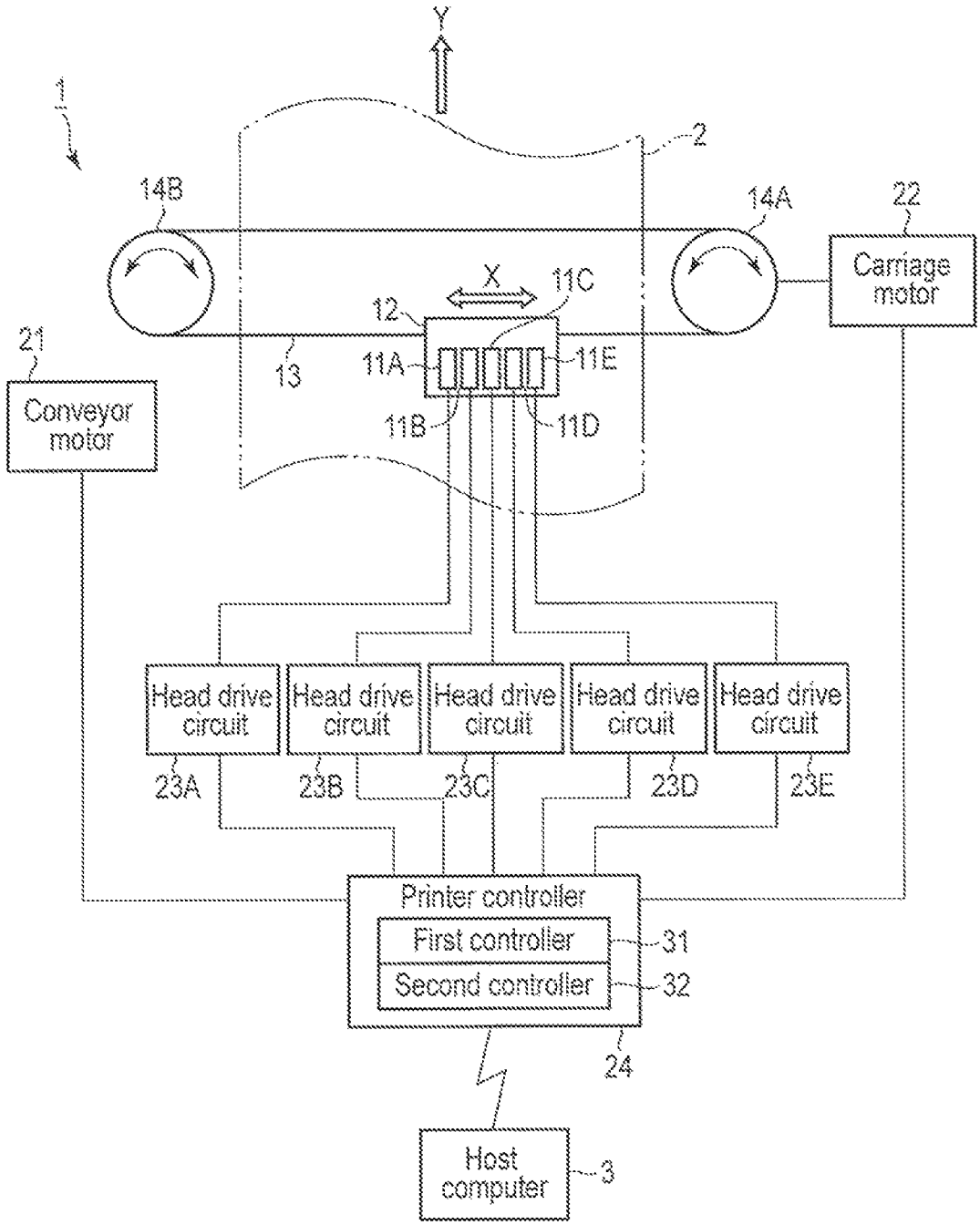
FIG. 1 is a block diagram showing a configuration of a main part of an inkjet recording apparatus.

FIG. 1 is a block diagram showing a configuration of a main part of the inkjet recording apparatus 1. In FIG. 1, an arrow X denotes a main scanning direction, and an arrow Y denotes a sub-scanning direction. Along the main scanning direction X, printing proceeds when a recording medium 2 and inkjet heads 11A to 11E move relatively to each other. The sub-scanning direction Y is perpendicular to the main scanning direction X.

The inkjet recording apparatus 1 conveys a recording medium 2 in the sub-scanning direction Y by a conveyor mechanism (not shown) which is driven by a conveyor motor 21 as a drive source. The recording medium 2 is not limited to any particular material, thickness, or size insofar as image formation is available by the inkjet recording apparatus 1.

The inkjet recording apparatus 1 comprises a head carriage 12 on which five inkjet heads 11A, 11B, 11C, 11D, and 11E are mounted. The head carriage 12 is attached to a carriage belt 13. The carriage belt 13 is wound between a pair of pulleys 14A and 14B which are respectively provided at one end side and the other end side along the main scanning direction. The pulley 14A at the one end side is fixed to a rotary shaft of a carriage motor 22 which can rotate in regular and reverse directions. Therefore, the carriage belt 13 reciprocally moves in the main scanning direction X according to regular or reverse rotation of the carriage motor 22. Further, the head carriage 12 is reciprocally moved, energized by reciprocal movement of the carriage belt 13.

When the head carriage 12 reciprocally moves, the inkjet recording apparatus 1 makes individual of the inkjet heads 11A to 11E selectively discharge ink drops. In this manner, the inkjet recording apparatus 1 forms an image of ink dots on a recording surface of the recording medium 2.

Each of the inkjet heads 11A to 11E employs a multi-drop method. The multi-drop method controls diameters of dots formed on the recording medium 2 by changing the number of ink drops ejected from each of the inkjet heads 11A to 11E.

Among the inkjet heads 11A to 11E, the head 11A is a head for a black ink (K) (hereinafter referred to as black head 11A). The head 11B is a head for a cyan ink (C) (hereinafter referred to as cyan head 11B). The head 11C is a head for a magenta ink (M) (hereinafter referred to as magenta head 11B). The head 11D is a head for yellow ink (Y) (hereinafter referred to as yellow head 11D). The head 11E is a head for white ink (W) (hereinafter referred to as white head 11E).

Print resolution is required for the black, cyan, magenta, and yellow color inks (K, C, M, and Y). These inks are referred to as first inks. Coverage over a recording surface of the recording medium 2 is required for the white ink (W). Such an ink is referred to a second ink.

The inkjet recording apparatus 1 further comprises head drive circuits 23A, 23B, 23C, 23D, and 23E respectively for the inkjet heads 11A to 11E, and a printer controller 24.

The printer controller 24 is connected to a host computer 3 such as a personal computer through an interface. The printer controller 24 controls the conveyor motor 21, carriage motor 22, and head drive circuits 23A to 23E, based on print data supplied form the host computer 3. Under control of the printer controller 24, the inkjet recording apparatus 1 forms a color image according to the print data on a print surface of the recording medium 2.

The printer controller 24 comprises a first controller 31 and a second controller 32.

The first controller 31 controls individuals of the inkjet heads 11A, 11B, 11C, and 11D which emits the first inks (K, C, M, and Y), in the following manner. Specifically, the first controller 31 controls ejection of inks from individuals of the inkjet heads 11A, 11B, 11C, and 11D so as to increase the number of ink dots formed in the main scanning direction, and to decrease the number of ink drops ejected for each one of the ink dots.

The second controller 32 controls the inkjet head 11E which ejects the second ink (W) in the following manner. Specifically, the second controller 31 controls ejection of an ink from the inkjet head 11E so as to decrease the number of ink dots formed in the main scanning direction X, and to increase the number of ink drops ejected for each one of the ink dots.

Figure 2:
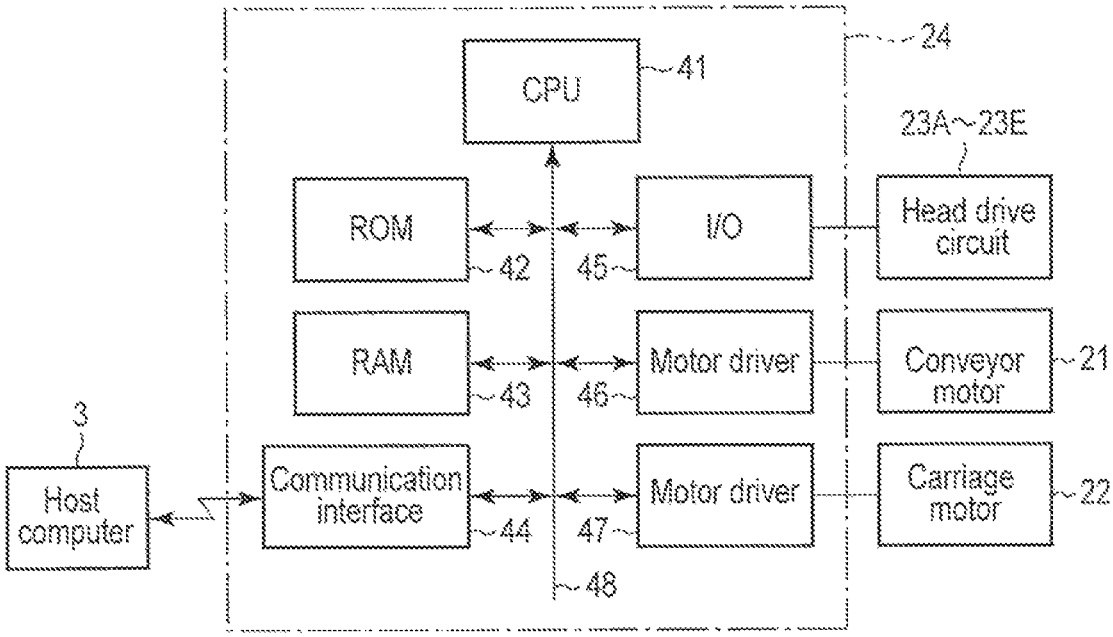
FIG. 2 is a block diagram showing a configuration of a main part of a printer controller.

FIG. 2 is a block diagram showing a configuration of a main part of the printer controller 24. The printer controller 24 comprises a central processing unit (CPU) 41, a read-only memory (ROM) 42, a random access memory (RAM) 43, a communication interface 44, an input/output (I/O) port 45, a first motor driver 46, and a second motor driver 47. The CPU 41 connects the ROM 42, RAM 43, communication interface 44, I/O port 45, and first and second motor drivers 46 and 47 through a bus line 48 such as an address bus and a data bus.

The CPU 41 forms a controller body. The ROM 42 stores fixed data such as a program. The RAM 43 has a region to temporarily store variable data.

The communication interface 44 receives print data transmitted from the host computer 3 in accordance with preset communication protocols. The CPU 41 analyzes the print data received through the communication interface 44, and prepares the print data for each of the inkjet heads 11A to 11E.

The I/O port 45 electrically connects the head drive circuits 23A to 23E. The CPU 41 transmits print data and control signals respectively corresponding to the inkjet heads 11A to 11E, to the drive circuits 23A to 23E through the I/O port 45. The control signals comprise a shift clock signal and a latch pulse signal and a timing pulse signal.

The first motor driver 46 drives the conveyor motor 21 in accordance with a command from the CPU 41. The second driver 47 drives the carriage motor 22 in accordance with a command from the CPU 41.

The CPU 41 performs, as the first controller 31 and second controller 32, controls by appropriately using regions of the RAM 43, based on the program stored in the ROM 42.

Figure 3:
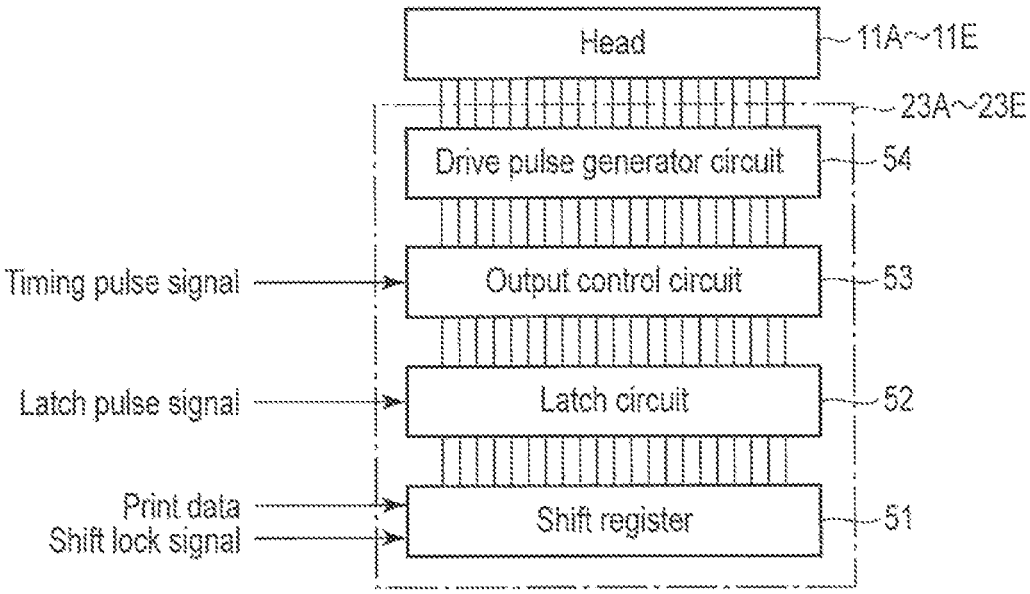
FIG. 3 is a block diagram showing head drive circuits.

The head drive circuits 23A to 23E have the same configurations as each other, and a main part thereof is shown in FIG. 3. FIG. 3 is a block diagram showing the head drive circuits 23A to 23E.

The head drive circuits 23A to 23E each comprise a shift register 51, a latch circuit 52, an output control circuit 53, and a drive pulse generator circuit 54. The shift register 51 connects to the latch circuit 52. The latch circuit 52 connects to the output control circuit 53. The output control circuit 53 connects to the drive pulse generator circuit 54.

The drive pulse generator circuit 54 connects to the inkjet heads 11A to 11E.

The shift register 51 stores print data supplied from the printer controller 24, sequentially shifting the print data in synchronization with a shift clock signal.

The latch circuit 52 latches the print data stored in the shift register 51, based on a latch pulse signal supplied from the printer controller 24.

The output control circuit 53 outputs the print data latched by the latch circuit 52 to the drive pulse generator circuit 54 in synchronization with a timing pulse signal supplied from the printer controller 24.

The drive pulse generator circuit 54 converts the print data supplied from the output control circuit 53 into drive pulse signals, and outputs the signals to the inkjet heads 11A to 11E.

Figure 4:
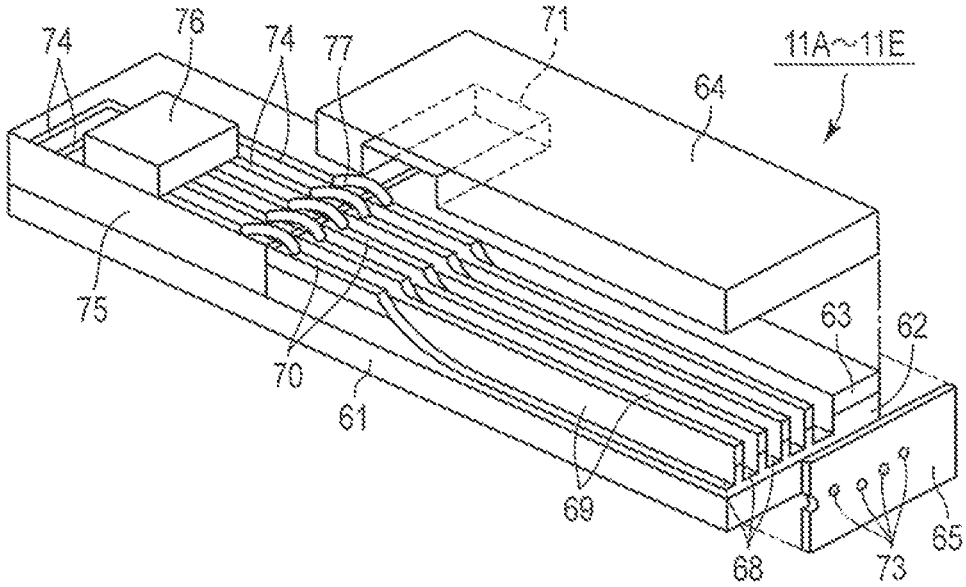
FIG. 4 is an exploded perspective view showing a part of an inkjet head.
Figure 5:
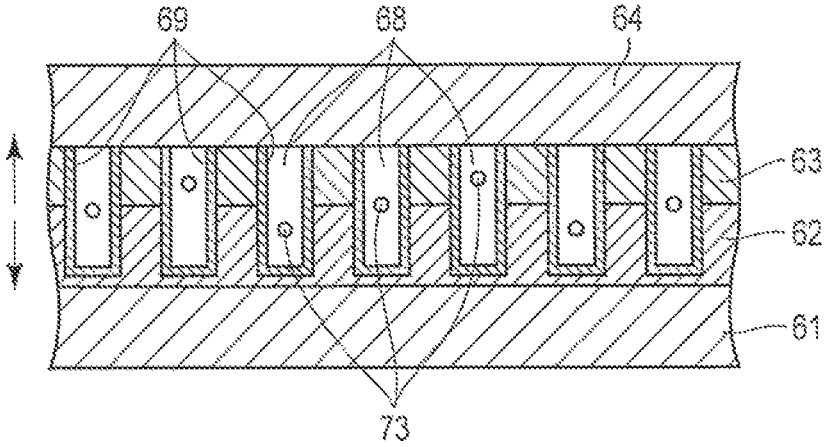
FIG. 5 is a cross-sectional view taken along a front part of the inkjet head.
Figure 6:
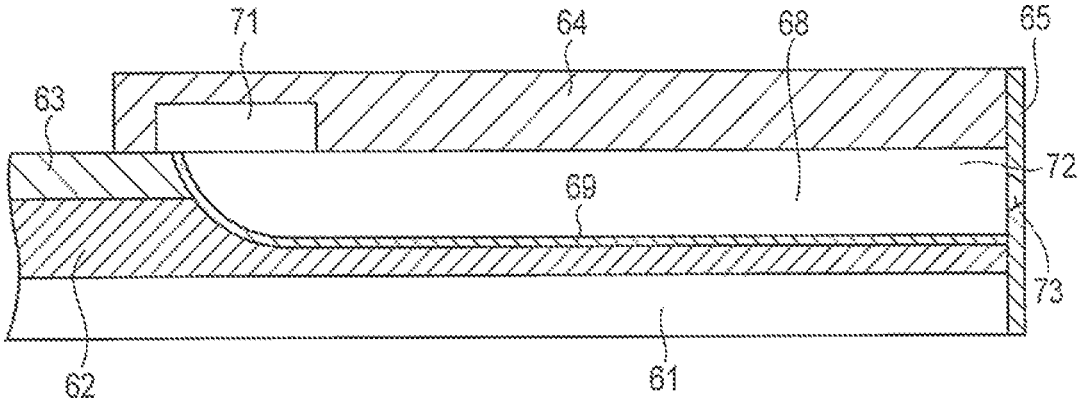
FIG. 6 is a longitudinal-sectional view taken along a front part of the inkjet head.

The inkjet heads 11A to 11E have the same configurations as each other, and main parts thereof are shown in FIGS. 4 to 6. FIG. 4 is a perspective view showing an exploded part of the inkjet heads 11A to 11E. FIG. 5 is a cross-sectional view taken along a front part of the heads 11A to 11E. FIG. 6 shows a longitudinal-sectional view taken along a front part of the heads 11A to 11E.

In the inkjet heads 11A to 11E each, a first piezoelectric member 62 is joined to an upper surface on a front side of a base board 61, and a second piezoelectric member 63 is joined to the first piezoelectric member 62. In the inkjet heads 11A to 11E each, the first piezoelectric member 62 and the second piezoelectric member 63 are joined, polarized in mutually opposite directions along thickness directions. Further, the inkjet heads 11A to 11E each are provided with a large number of grooves 68 extended from front ends of the joined piezoelectric members 62 and 63 toward rear ends thereof. The grooves 68 are provided at constant intervals in parallel. The grooves 68 each have an open front ends and a rear end inclined up.

In the inkjet heads 11A to 11E, electrodes 69 are provided on sidewalls and a bottom surface of each of the grooves 68. Further, the inkjet heads 11A to 11E are provided with lead electrodes 70 respectively extended from the electrodes 69, e.g., from the rear ends of the grooves 68 toward the rear upper surface of the second piezoelectric member 63.

In the inkjet heads 11A to 11E, upper parts of the grooves 68 are respectively closed by a ceiling plate 64, and front ends of the grooves 68 are closed with an orifice plate 65. The ceiling plate 64 internally comprises a common ink chamber 71 on a rear side. In the inkjet heads 11A to 11E each, nozzles 72 for ejecting an ink are formed by the grooves 68 surrounded between the ceiling plate 64 and the orifice plate 65. The nozzles 72 are also referred to as ink chambers. In the inkjet heads 11A to 11E each, ink ejection ports 73 are opened at positions of the orifice plate 65 opposed to the grooves 68.

In the inkjet heads 11A to 11E each, a printed board 75 where a conductive pattern 74 is formed is joined to an upper surface of a rear part of the base board 61. In the inkjet heads 11A to 11E each, a drive IC 76 is mounted on the printed board 75. Each drive IC 76 is connected to the conductive pattern 74. The conductive pattern 74 is connected, by wire bonding, to the lead electrodes 70 through the leads 77. The drive IC 76 forms the head drive circuits 23A to 23E.

Next, operation principles of the inkjet heads 11A to 11E configured as described above will be described with reference to FIGS. 7A to 7C and FIG. 8.

Figure 7A:
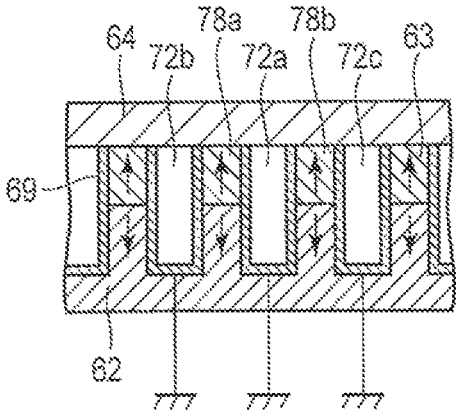
FIGS. 7A, 7B and 7C are respectively schematic views for explaining operation principles of inkjet heads.

FIG. 7A shows a state where the electrodes 69 of a center nozzle 72*a* and two adjacent nozzles 72*b* and 72*c* to the nozzle 72*a* are all at a ground potential. In this state, sidewalls 78*a* and 78*b*, which are formed of the piezoelectric members 62 and 63 between the nozzles 72*a* and 72*b* and between nozzles 72*a* and 72*c*, respectively, are not affected to deform.

Figure 7B:
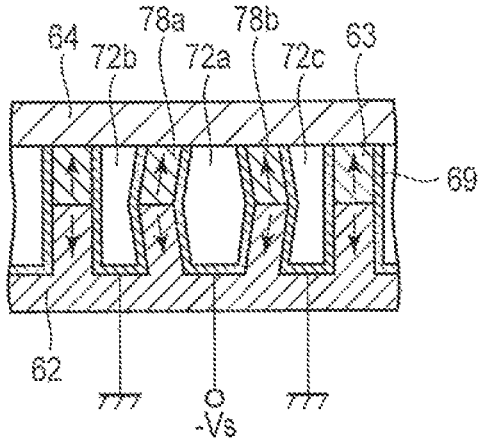

FIG. 7B shows a state where a negative voltage (−Vs) is applied to the electrode 69 of the center nozzle 72*a*. The electrodes 69 of the two adjacent nozzles 72*b* and 72*c* are both at the ground potential. In this state, an electric field acts on the walls 78*a* and 78*b*, in directions perpendicular to polarization directions of the piezoelectric members 62 and 63. This action causes the sidewalls 78*a* and 78*b* to deform outside so as to expand a volume of the nozzle 72*a*.

Figure 7C:
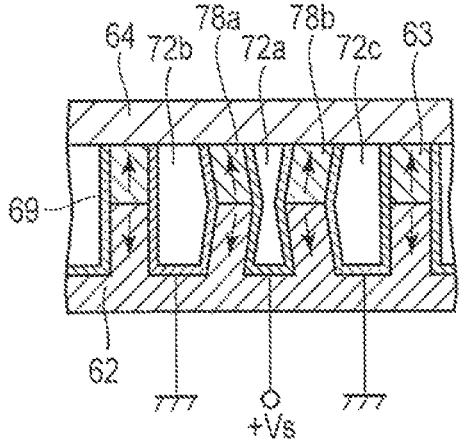

FIG. 7C shows a state where the electrode 69 of the center nozzle 72*a* is applied with a positive voltage (+Vs). The electrodes 69 of the two adjacent nozzles 72*b* and 72*c* are both at the ground potential. In this state, an electric field acts on the walls 78*a* and 78*b*, in directions which are perpendicular to polarization directions of the piezoelectric members 62 and 63 and are opposite to the directions shown in the case of FIG. 7B. This action causes the sidewalls 78*a* and 78*b* to deform inside so as to contract a volume of the nozzle 72*a*.

Figure 8:
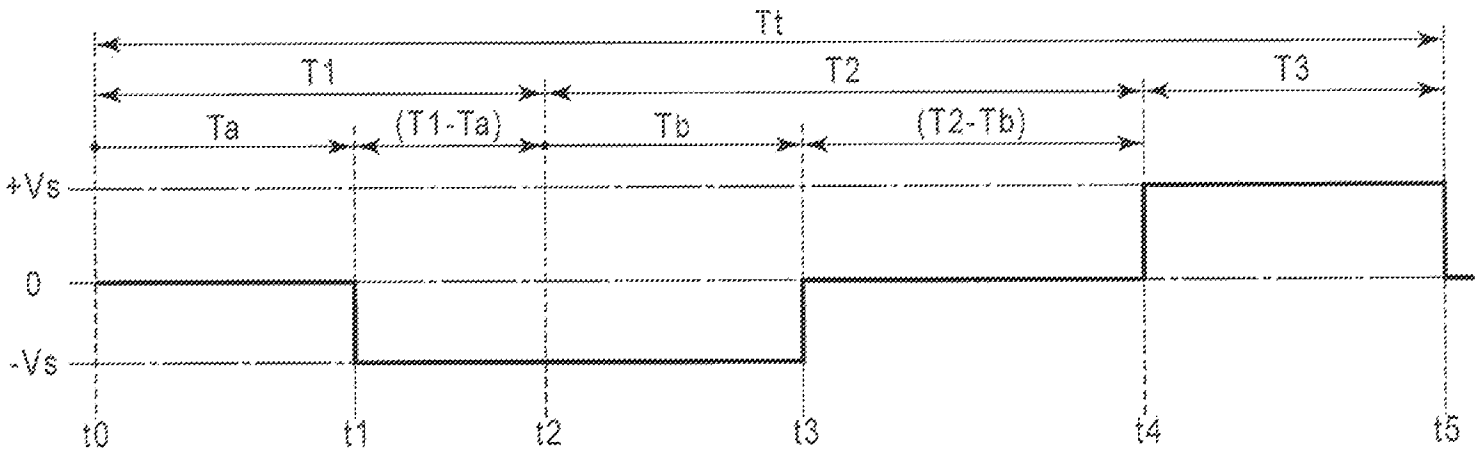
FIG. 8 shows a conduction waveform of a drive pulse signal applied to electrodes of nozzles of inkjet heads.

FIG. 8 shows a conduction waveform of a drive pulse signal applied to the electrode 69 of the nozzle 72*a*, in order to eject an ink drop from the nozzle 72*a*. A segment denoted as a period Tt is required to eject one drop of ink, and is divided into a period T1 as a preparation segment, a period T2 as an ejection segment, and a period T3 as a post-processing segment. The preparation segment T1 is subdivided into a period Ta as a regular segment and a period (T1-Ta) as an extended segment. The period T2 as the ejection segment is subdivided into a period Tb as a sustained segment and a period (T2-Tb) as a recovery segment. The preparation segment T1, ejection segment T2, and post-processing segment T3 are set to appropriate values under conditions, such as inks to use and temperatures.

As shown in FIG. 8, the head drive circuits 23A to 23E firstly apply a voltage of zero to the electrodes 69 corresponding to the nozzles 72*a*, 72*b*, and 72*c*, in time t0. Then, elapse of a regular segment Ta is awaited. During this time, the nozzles 72*a*, 72*b*, and 72*c* each are in a state as shown in FIG. 7A.

When time t1 is reached upon elapse of the regular segment Ta, the head drive circuits 23A to 23E each apply a predetermined negative voltage (−Vs) to the electrode corresponding to the nozzle 72*a*. Then, elapse of the preparation segment T1 is awaited. When the negative voltage (−Vs) is applied, the sidewalls 78*a* and 78*b* on two sides of each nozzle 72*a* deform outside so as to expand the volume of the nozzle 72*a*, and reach a state as shown in FIG. 7B. This deformation reduces pressure inside each nozzle 72*a*. Therefore, an ink flows into the nozzle 72*a* from the common ink chamber 71.

When time t2 is reached upon elapse of the preparation segment T1, the head drive circuits 23A to 23E continue to apply the negative voltage (−Vs) to the electrodes 69 corresponding to the nozzles 72*a* until the sustained segment Tb further elapses. During this time, the nozzles 72*a*, 72*b*, and 72*c* maintain a state as shown in FIG. 7B.

When time t3 is reached upon elapse of the sustained segment Tb, the head drive circuits 23A to 23E return to 0 V, the voltage applied to the electrodes 69 corresponding to the nozzles 72*a*. Further, elapse of the ejection segment T2 is awaited. When the applied voltage becomes zero, the walls 78*a* and 78*b* on two sides of each nozzle 72*a* are restored into a regular state, and return into the state as shown in FIG. 7A. This recovery increases pressure inside each nozzle 72*a*. Therefore, an ink drop is ejected from an ink ejection port 73 corresponding to each nozzle 72*a*.

When time t4 is reached upon elapse of the ejection segment T2, the head drive circuits 23A to 23E apply the predetermined positive voltage (+Vs) to the electrode 69 corresponding to the nozzles 72*a*. Further, elapse of the post-processing segment T3 is awaited. When the positive voltage (+Vs) is applied, the walls 78*a* and 78*b* on two sides of each nozzle 72*a* deform inside so as to contract the volume of the nozzle 72*a*, and reach a state as shown in FIG. 7C. This deformation further increases the pressure inside each nozzle 72*a*. Therefore, an abrupt pressure drop which may be caused in each nozzle 72*a* by ejection of an ink drop is relaxed.

When time t5 is reached upon elapse of the post-processing segment T3, the head drive circuits 23A to 23E return again to 0 V, the voltage applied to the electrodes 69 corresponding to the nozzles 72*a*. In response to the applied voltage returned to zero, the walls 78*a* and 78*b* on two sides of each nozzle 72*a* are restored into the regular state. That is, the nozzles 72*a*, 72*b*, and 72*c* each return to the state as shown in FIG. 7A.

The head drive circuits 23A to 23E supply the electrodes 69 of the nozzles 72*a* with the drive pulse signal having the conduction waveform shown in FIG. 8. Then, an ink drop is ejected from the ink ejection port 73 corresponding to the nozzle 72*a*.

Next, gradation printing according to the multi-drop method will be described with reference to FIGS. 9A to 9D and FIG. 10. In the multi-drop method, density of each one dot is changed by changing a number of ink drops to be ejected to the each one dot in order to express gradations. The size of each ink drop is unchanged.

Specifically, the head drive circuits 23A to 23E each repeatedly output the drive pulse voltage having the conduction waveform as shown in FIG. 8, a plurality of times, to the electrode 69 of the nozzle 72. Then, ink drops corresponding in number to the plurality of times are sequentially ejected from the ink ejection port 73 corresponding to the nozzle 72. As a result, gradation printing is achieved according to the multi-drop method.

FIGS. 9A to 9D show states of ink drops 81 ejected from an ink ejection port 73, and dots 82 formed of the ink drops 81 which reach and penetrate the recording medium 2.

Figure 9A:
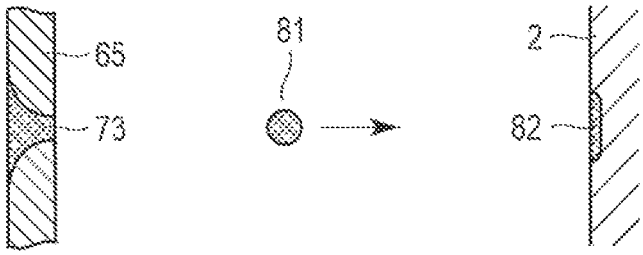
FIGS. 9A, 9B, 9C and 9D are respectively schematic views for explaining gradation printing of each inkjet head according to a multi-drop method.

FIG. 9A shows printing in one gradation. At this time, one ink drop 81 is ejected (number of drops=1), and therefore, a small volume of ink penetrates the recording medium 2.

Figure 9B:
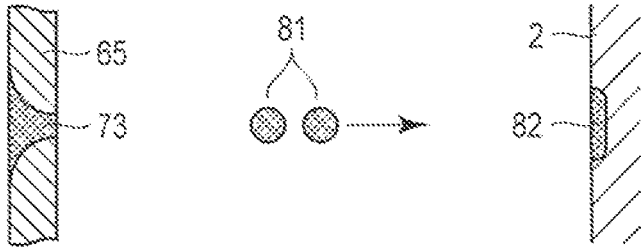

FIG. 9B shows printing in two gradations. At this time, two ink drops 81 are ejected (number of drops=2). Therefore, a volume of the ink which penetrates the recording medium 2 is substantially twice the volume in the one gradation, and the diameter of the dot increases.

Figure 9C:
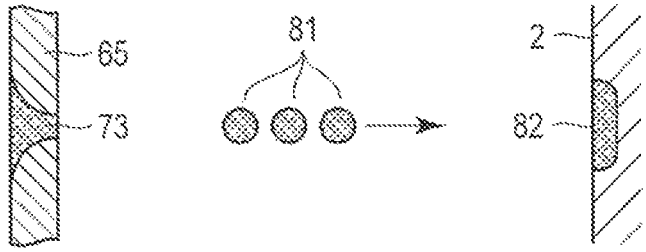

FIG. 9C shows printing in three gradations. At this time, three ink drops 81 are ejected (number of drops=3). Therefore, a volume of the ink which penetrates the recording medium 2 is substantially three times the volume in the one gradation, and the diameter of the dot further increases.

Figure 9D:
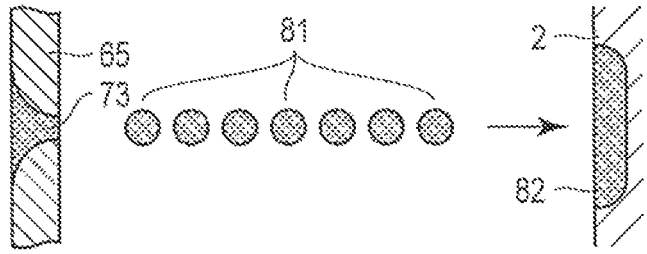

FIG. 9D shows printing in seven gradations. At this time, seven ink drops 81 are given (number of drops=7). Therefore, a volume of the ink which penetrates the recording medium 2 is substantially seven times the volume in the one gradation. Supposing that seven gradations are maximum gradations, a dot having the greatest diameter is printed on the recording medium 2.

Though four to six gradations are not shown, the number of ink drops increases depending on the number of gradations. The volume of ink which penetrates the recording medium 2 increases accordingly.

Thus, in the gradation printing according to the multi-drop method, a relationship between the number of ink drops to eject and the print density changes linearly. Accordingly, excellent gradation printing can be achieved by controlling the number of ink drops to eject, depending on the number of drive pulses.

Figure 10:
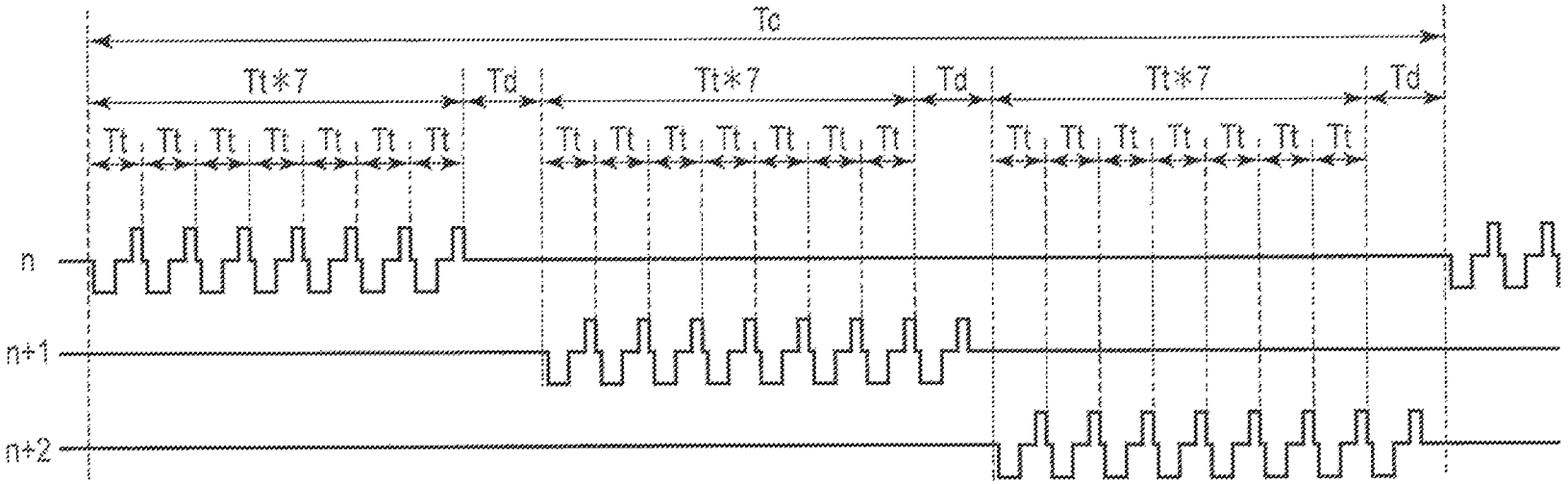
FIG. 10 shows conduction waveforms of drive pulse signals when printing is performed in maximum gradations set to seven gradations by the inkjet heads.

FIG. 10 shows a conduction waveform of a drive pulse signal when printing is performed where the maximum gradations are set to seven gradations. When an ink is ejected from the nozzle 72*a* in one of the inkjet heads 11A to 11E, two adjacent nozzles 72*b* and 72*c* which share sidewalls with the nozzle 72*a* cannot eject inks.

Hence, the nozzles 72 are divided into three groups of n, n−1, and n+1. Specifically, supposing that a nozzle 72*a* belongs to group n, division is performed in a manner that a nozzle 72*b* adjacent to the nozzle 72*a* on one side belongs to group n−1, and a nozzle 72*c* adjacent to the nozzle 72*a* on the other side belongs to group n+1.

The head drive circuits 23A to 23E supply the drive pulse signal to the electrodes 69 of the nozzles 72*a* at timings shifted respectively for the groups, as shown in FIG. 10.

If a delay time between one another of the groups is Td, a cycle time Tc required for three-division driving at the time of the maximum seven gradations is expressed by expression (1) below.

$$Tc=(Tt\times 7+Td)\times 3 \quad (1)$$

A drive frequency F is an inverse number of the cycle time Tc, and is therefore expressed by expression (2) below.

$$F=1/(Tt\times 7+Td)\times 3 \quad (2)$$

Operation principles of the inkjet heads 11A to 11E according to the multi-drop method have been described above.

Meanwhile, the inkjet heads 11A to 11E used in the first embodiment can be driven by maximum drive frequencies, as values shown in Table 1, depending on ink ejection volumes.

TABLE 1

| Print data (head transfer data) | Number of applications of basic drive waveform | Ejection volume [pL] | Maximum drive frequency [Hz] |
|---|---|---|---|
| 0Hex | 0 | 0 | — |
| 1Hex | 1 | 6 | 28000 |
| 2Hex | 2 | 12 | 16700 |
| 3Hex | 3 | 18 | 13000 |
| 4Hex | 4 | 24 | 10000 |
| 5Hex | 5 | 30 | 8400 |
| 6Hex | 6 | 36 | 7100 |
| 7Hex | 7 | 42 | 6200 |
| 8Hex | 8 | 48 | 5400 |
| 9Hex | 9 | 54 | 4400 |

That is, an ink ejection volume is 6 pL when print data is 1 Hex (hexadecimal), i.e., when the basic drive waveform shown in FIG. 8 is applied once (one drop). At this time, the maximum drive frequency is 28,000 Hz. An ink ejection volume is 12 pL when print data is 2 Hex, i.e., when the basic drive waveform shown in FIG. 8 is applied twice (two drops). At this time, the maximum drive frequency is 16,700 Hz. Relationships between further ink ejection volumes of 3 to 9 Hex and maximum drive frequencies are as shown in Table 1.

Figure 11:
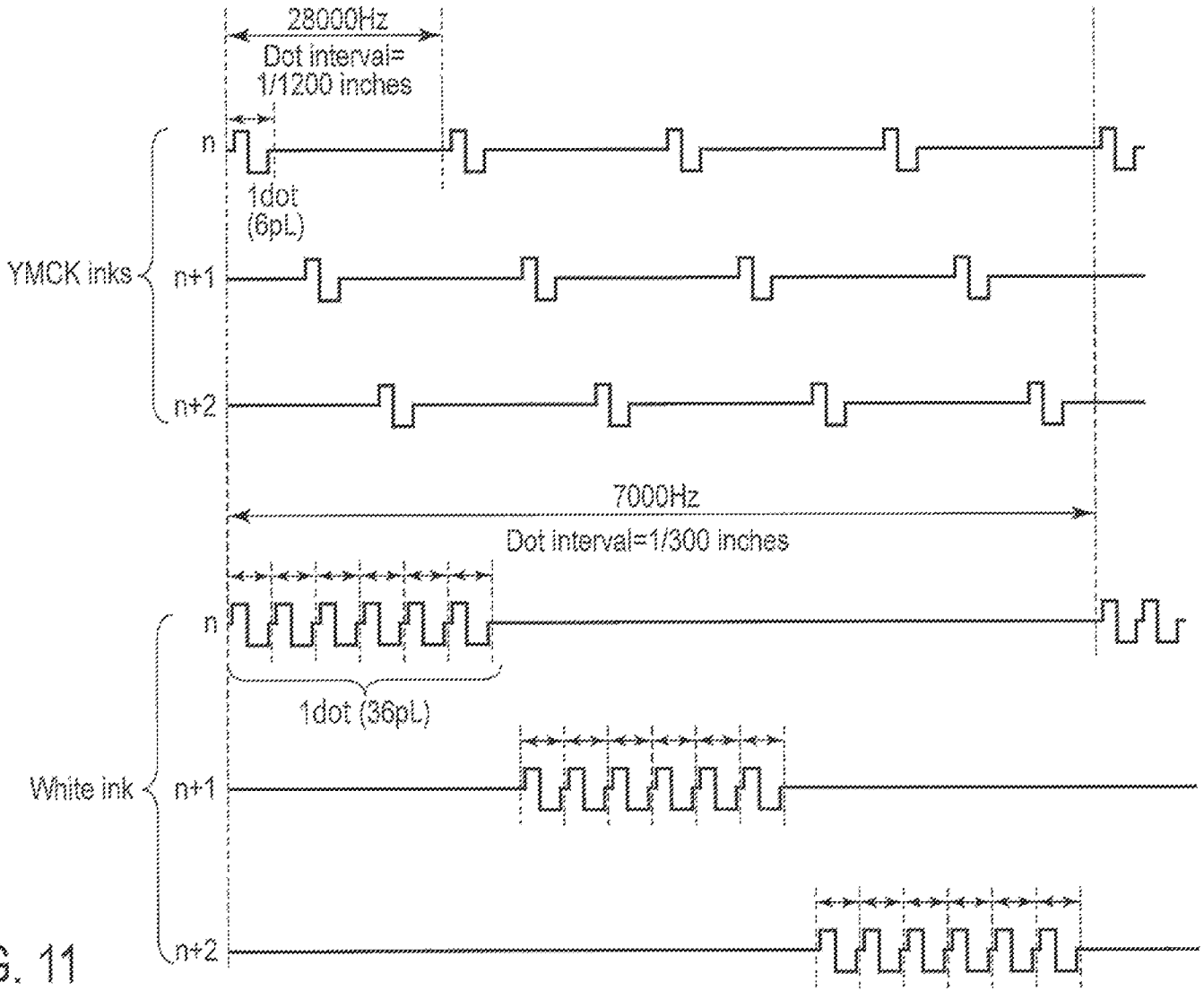
FIG. 11 shows conduction waveforms of drive pulse signals applied to inkjet heads which respectively eject color inks and an inkjet head which ejects a white ink, according to the first embodiment.

Thus, the inkjet heads 11A to 11E have a feature that the drive frequency can be increased as the number of drops to eject decreases. By utilizing this feature, the inkjet heads 11A, 11B, 11C, and 11D which eject the color inks (K, C, M, and Y), and the inkjet head 11E which ejects the white ink, according to the first embodiment are controlled, in the first embodiment, as shown in FIG. 11.

That is, the inkjet heads 11A, 11B, 11C, and 11D form an image according to print data by ejecting ink drops 81 one after another (6 pL) at a high resolution of 12,000 dpi in the main scanning direction X at a speed of 28,000 dots per second. Such ejection control is performed by the first controller 31.

In contrast, the inkjet head 11E which ejects the white ink (W) forms an image as a ground by sequentially emitting six ink drops 81 (36 pL) at low resolution of 300 dpi in the main scanning direction at a speed of 7,000 dots per second. Such ejection control is performed by the second controller 32.

Resolution in the sub-scanning direction is the same 1,200 dpi as when the color inks (K, C, and Y) are ejected.

Figure 12:
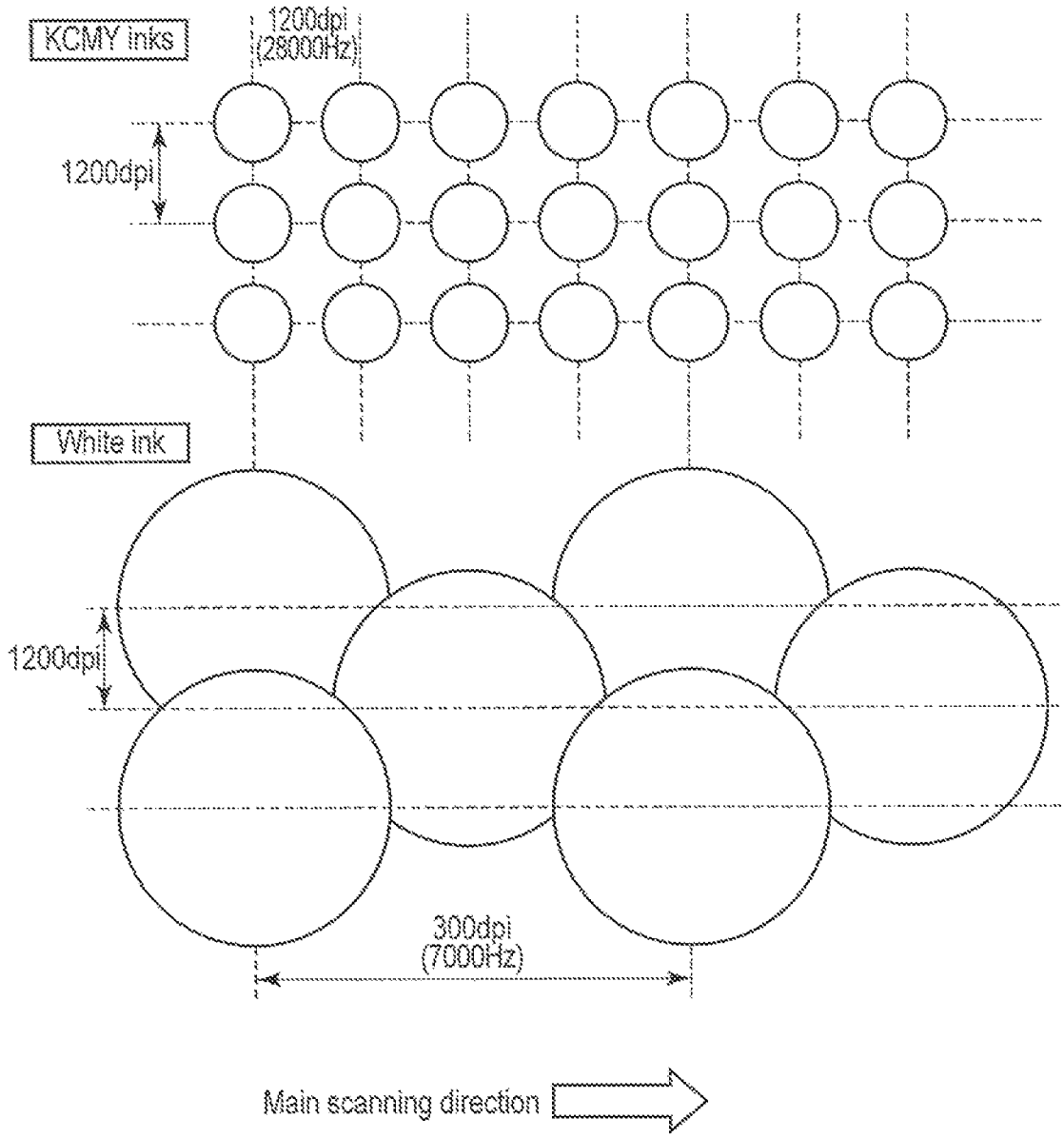
FIG. 12 is a schematic view showing print results of the color inks and white ink according to the first embodiment.

FIG. 12 shows results of printing the color inks (K, C, M, and Y) and white ink (W) under emission control as described above. The resolution in the main scanning direction X, drive frequencies of the inkjet heads 11A, 11B, 11C, 11D, and 11E, ejection volumes of the ink drops 81, moving speeds of the inkjet heads 11A, 11A, 11B, 11C, 11D, and 11E in the main scanning direction X, and ejection volumes of the ink drops 81 when the resolution in the main scanning direction X is 300 dpi are as shown in Table 2 for the color inks (K, C, M, and Y) and white ink (W).

TABLE 2

| | KCMY inks | W ink |
|---|---|---|
| Print resolution in main-scanning direction | 1200 dpi | 300 dpi |
| Head drive frequency | 28000 Hz | 7000 Hz |
| Ejection volume | 6 pL | 36 pL |
| Head moving speed in main scanning direction | 593 mm/s | 593 mm/s |
| Ejection volume at resolution 300 dpi | 24 pL | 36 pL |

As is apparent from FIG. 12 and Table 2, an ejection volume of the white ink (W) per unit area is about 1.5 times greater than that of the color inks (K, C, M, and Y) each. Therefore, coverage of the white ink (W) over the print surface of the recording medium 2 improves. In contrast, a print speed in the main scanning direction X is equalized to that of the color inks (K, C, M, and Y) each, by reducing resolution of printing by the white ink (W), and does not decrease.

Therefore, the inkjet recording apparatus 1 according to the first embodiment achieves an effect of increasing coverage of the white ink (W) over a print surface of a recording medium, without reducing the print speed.

Second Embodiment

According to the second embodiment, an image is formed by ejecting, at most, two ink drops 81 for from each of inkjet heads 11A, 11B, 11C, and 11D which respectively eject color inks (K, C, M, and Y). Hardware part of an inkjet recording apparatus 1 is the same as that in the first embodiment. Therefore, FIGS. 1 to 10 and Table 1 are also referred to in the second embodiment, and detailed descriptions thereof will be omitted.

Figure 13:
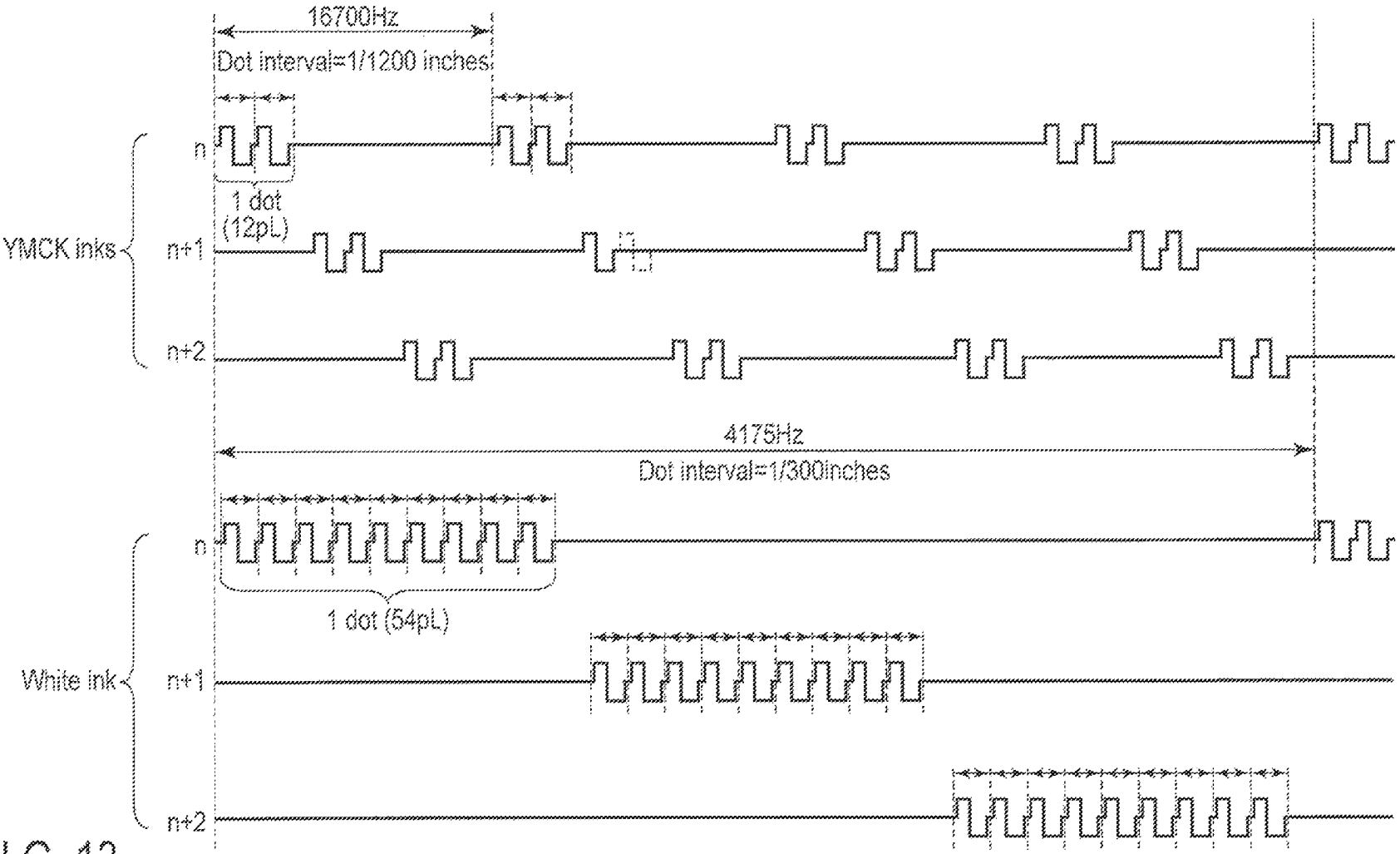
FIG. 13 shows conduction waveforms of drive pulse signals applied to inkjet heads which respectively eject color inks and an inkjet head which ejects a white ink, according to the second embodiment.

In the second embodiment, as shown in FIG. 13, the inkjet heads 11A, 11B, 11C, and 11D which respectively eject the color inks (K, C, M, and Y) form an image of print data by ejecting two ink drops (12 pL) or one ink drop (6 pL) at high resolution of 1,200 dpi in the main scanning direction X at a speed of 167,000 dots per second. In brief, images are expressed in two gradations. Such ejection control is performed by a first controller 31.

In contrast, an inkjet head 11E which ejects a white ink (W) forms an image as a ground by sequentially emitting nine ink drops (54 pL) at low resolution of 300 dpi in the main scanning direction X at a speed of 4,175 dots per second. Such ejection control is performed by a second controller 32.

Resolution in the sub-scanning direction is the same 1,200 dpi as when the color inks (K, C, M, and Y) are ejected.

Figure 14:
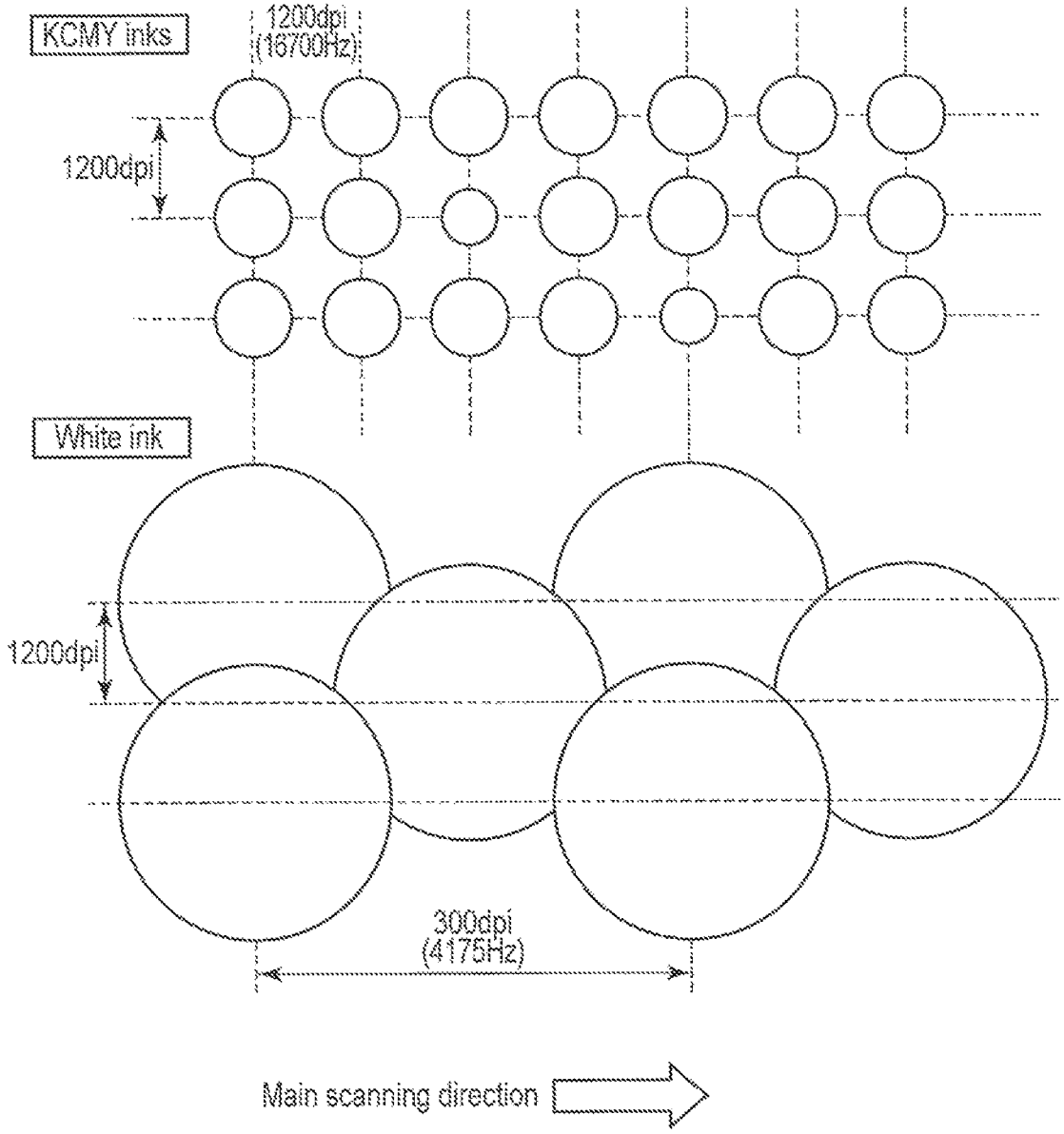
FIG. 14 is a schematic view showing print results of the color inks and white ink according to the second embodiment.

FIG. 14 shows results of printing the color inks (K, C, M, and Y) and white ink (W) under emission control as described above.

The resolution in the main scanning direction X, drive frequencies of the inkjet heads 11A, 11B, 11C, 11D, and 11E, ejection volumes of the ink drops 81, moving speeds of the inkjet heads 11A, 11A, 11B, 11C, 11D, and 11E in the main scanning direction X, and ejection volumes of the ink drops 81 when the resolution in the main scanning direction X is 300 dpi are as shown in Table 3 for the color inks (K, C, M, and Y) and white ink (W).

TABLE 3

| | KCMY inks | W ink |
|---|---|---|
| Print resolution in main-scanning direction | 1200 dpi | 300 dpi |
| Head drive frequency | 16700 Hz | 4175 Hz |
| Ejection volume | 6-12 pL | 36 pL |
| Head moving speed in main scanning direction | 353 mm/s | 353 mm/s |
| Ejection volume at resolution 300 dpi | 48(max.) pL | 54 pL |

As is apparent from FIG. 14 and Table 3, an ejection volume of the white ink (W) per unit area is about 1.125 times greater than that of the color inks (K, C, M, and Y) each. Therefore, coverage of the white ink (W) over a print surface of a recording medium 2 improves. In contrast, a print speed in the main scanning direction X is equalized to that of the color inks (K, C, M, and Y) each, by reducing resolution of printing by the white ink (W), and does not decrease.

Therefore, the inkjet recording apparatus 1 according to the second embodiment can also achieve the same operation and effect as according to the first embodiment.

The foregoing embodiments have exemplified application to the inkjet recording apparatus 1 on which five inkjet heads 11A, 11B, 11C, 11D, and 11E are mounted. However, the number of heads is not limited to five. The embodiments are applicable to any inkjet recording apparatus insofar as, at least, two or more inkjet heads which employ first and second inks are mounted on the inkjet recording apparatus wherein print resolution is required for the first ink, like a color ink, and coverage over a recording medium is required for the second ink, like a white ink.

Although the foregoing embodiments use a white ink (W) as the second ink, the second ink is not limited to this ink. For example, the embodiments are applicable to an inkjet recording apparatus in which a second ink is an ink for overcoating an image formed by color inks as first inks (K, C, M, and Y) on a recording surface of a recording medium 2.

Similarly, the embodiments are also applicable to an inkjet recording apparatus in which a second ink is an ink for undercoating an image formed by color inks as first inks (K, C, M, and Y) on a recording surface of a recording medium 2.

The embodiments are still also applicable to an inkjet recording apparatus which prints first and second inks on a circuit board wherein the first ink for which resolution is required is used for circuit symbols and the second ink for which coverage is required is a resist ink.

In the inkjet recording apparatuses 1 according to the foregoing embodiments, the inkjet heads 11A to 11E are arrayed in the main scanning direction X and are mounted on the head carriage 12. Further, by reciprocally moving the head carriage 12 along the main scanning direction X, an image is formed on a recording surface of the recording medium 2 which moves in the sub-scanning direction Y. However, the embodiments are also applicable to an inkjet recording apparatus in which a plurality of line heads are arrayed along a conveying direction of the recording medium 2.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet recording apparatus comprising:

a plurality of inkjet heads of a multi-drop method, each of which controls a diameter of each ink dot formed on a recording medium by changing a number of ink drops to sequentially eject;

a first controller which controls ejection of the ink drops from a first inkjet head for ejecting a first ink for which print resolution is required, among the plurality of inkjet heads, in a manner that the number of the ink dots formed in a main scanning direction as a printing direction during relative movement between the recording medium and the inkjet heads is increased, and that the number of ink drops ejected for each one of the ink dots is decreased; and a second controller which controls ejection of the ink drops from a second inkjet head for ejecting a second ink for which coverage over a recording surface of the recording medium is required, among the plurality of inkjet heads, in a manner that the ink drops in the main scanning direction are ejected at a resolution lower than the first inkjet head, that the ink drops in a sub-scanning direction which is perpendicular to the main scanning direction are ejected at the same resolution as the first inkjet head, that the number of the ink dots formed in the main scanning direction is decreased, and that the number of ink drops ejected for each one of the ink dots is increased.

2. The apparatus of claim 1, wherein the first ink is a color ink, and the second ink is a white ink.

3. The apparatus of claim 1, wherein the first ink is a color ink, and the second ink is an ink for overcoating.

4. The apparatus of claim 1, wherein the first ink is a color ink, and the second ink is an ink for undercoating.

5. The apparatus of claim 1, wherein the first ink is an ink for circuit symbols, and the second ink is a resist ink.

6. An inkjet recording apparatus comprising:

a first inkjet head which ejects a first ink for which print resolution is required;

a second inkjet head which ejects a second ink for which coverage over a recording surface of a recording medium is required; and a printer controller which controls ejection of the ink drops from the first inkjet head, in a manner that the number of ink dots formed in a main scanning direction as a printing direction during relative movement between the recording medium and the inkjet heads is great, and that the number of ink drops ejected for each one of the ink dots is small, and controls ejection of the ink drops from a second inkjet head, in a manner that the ink drops in the main scanning direction are ejected at a resolution lower than the first inkjet head, that the ink drops in a sub-scanning direction which is perpendicular to the main scanning direction are ejected at the same resolution as the first inkjet head, that the number of ink dots formed in the main scanning direction is small, and that the number of ink drops ejected or each one of the ink dots is great.

7. The apparatus of claim 6, wherein the first ink is a color ink, and the second ink is a white ink.

8. The apparatus of claim 6, wherein the first ink is a color ink, and the second ink is an ink for overcoating.

9. The apparatus of claim 6, wherein the first ink is a color ink, and the second ink is an ink for undercoating.

10. The apparatus of claim 6, wherein the first ink is an ink for circuit symbols, and the second ink is a resist ink.

11. An inkjet recording method for an inkjet recording apparatus, comprising:

a plurality of inkjet heads comprised in the inkjet recording apparatus, the inkjet heads being of a multi-drop method each of which controls a diameter of each ink dot formed on a recording medium by changing a number of ink drops to sequentially eject;

controlling ejection of the ink drops from a first inkjet head for ejecting a first ink for which print resolution is required, among the plurality of inkjet heads, in a manner that the number of the ink dots formed in a main scanning direction as a printing direction during relative movement between the recording medium and the inkjet heads is increased, and that the number of ink drops ejected for each one of the ink dots is decreased; and controlling ejection of the ink drops from a second inkjet head for ejecting a second ink for which coverage over a recording surface of the recording medium is required, among the plurality of inkjet heads, in a manner that the ink drops in the main scanning direction are ejected at a resolution lower than the first inkjet head, that the ink drops in a sub-scanning direction which is perpendicular to the main scanning direction are ejected at the same resolution as the first inkjet head, that the number of the ink dots formed in the main scanning direction is decreased, and that the number of ink drops ejected for each of the ink dots is increased.

12. The method of claim 11, wherein the first ink is a color ink, and the second ink is a white ink.

13. The method of claim 11, wherein the first ink is a color ink, and the second ink is an ink for overcoating.

14. The method of claim 11, wherein the first ink is a color ink, and the second ink is an ink for undercoating.

15. The method of claim 11, wherein the first ink is an ink for circuit symbols, and the second ink is a resist ink.

* * * * *